US007389906B2

(12) United States Patent
Sih

(10) Patent No.: US 7,389,906 B2
(45) Date of Patent: Jun. 24, 2008

(54) CONFIDENTIAL ENVELOPE/BAG

(76) Inventor: Yung-Chah Sih, 4F, No. 17, Lane 222, Tun-Hua N. Rd., Taipei (TW)

( * ) Notice: Subject to any disclaimer, the term of this patent is extended or adjusted under 35 U.S.C. 154(b) by 554 days.

(21) Appl. No.: 10/759,302

(22) Filed: Jan. 20, 2004

(65) Prior Publication Data

US 2004/0251298 A1 Dec. 16, 2004

(30) Foreign Application Priority Data

Jun. 10, 2003 (TW) ..... 92210564 U

(51) Int. Cl.

| | |
|---|---|
| ***B65D 27/14*** | (2006.01) |
| ***B65D 27/04*** | (2006.01) |
| ***B65D 33/14*** | (2006.01) |
| ***B65D 33/04*** | (2006.01) |
| ***B42D 15/00*** | (2006.01) |

(52) U.S. Cl. ..... 229/80; 229/71; 383/5; 383/106; 283/116

(58) Field of Classification Search ..... 229/71, 229/80; 383/5, 106, 107; 283/116
See application file for complete search history.

(56) References Cited

U.S. PATENT DOCUMENTS

| | | | | | |
|---|---|---|---|---|---|
| 203,091 | A | * | 4/1878 | Taylor | 283/116 |
| 1,091,028 | A | * | 3/1914 | Wroeger | 229/68.1 |
| 1,714,349 | A | * | 5/1929 | Dahlke | 283/116 |
| 3,015,438 | A | * | 1/1962 | Knight | 235/489 |
| 3,933,304 | A | * | 1/1976 | Judd | 383/5 |
| 4,720,040 | A | * | 1/1988 | Gurewitz | 383/5 |
| 5,205,649 | A | * | 4/1993 | Fullerton | 383/5 |
| 5,478,010 | A | * | 12/1995 | Vaucher | 229/80 |
| 5,727,686 | A | * | 3/1998 | Kristal | 206/459.1 |
| 5,788,377 | A | * | 8/1998 | Vetter | 383/5 |

FOREIGN PATENT DOCUMENTS

| | | | | | |
|---|---|---|---|---|---|
| GB | 1025034 | | * | 4/1966 | 383/5 |
| GB | 2 051 003 | A | * | 1/1981 | 383/5 |
| GB | 2 149 381 | A | * | 6/1985 | 383/5 |
| JP | 61-110547 | | | 7/1986 | |

* cited by examiner

*Primary Examiner*—Jes F Pascua
(74) *Attorney, Agent, or Firm*—Rabin & Berdo, P.C.

(57) ABSTRACT

A confidential envelope/bag is composed of a face and a back. The face and the back are linked with each other and formed with an edge at circumference; a sealing print is formed across the edges either at the back or on both the face and the back. The sealing print includes patterns, marks, graphics, texts or numbers made of paint, coating, ink, fluorescent dye, or even concaves, or extrusions. The circumference of the face and the back are adhered to each other with a suitable region to form a sealing zone.

5 Claims, 5 Drawing Sheets

CONFIDENTIAL ENVELOPE/BAG

BACKGROUND OF THE INVENTION

1. Field of the Invention

The invention generally relates to an envelope/bag used for confidential materials and in particular relates to an envelope/bag that leaves visible evidence when being opened.

2. Related Art

Conventional mails in the past several centuries have played an important role in communicating and expressing one's feelings and emotions (not to mention what one can put in the mail). In order to ensure privacy, various types of envelopes and bags were developed to contain such information.

As "privacy" tends to draw unwanted curiosity, in order to easily detect whether contents inside the envelope or bag has been tampered, sealing methods from ancient wax seals to today's super bond glue and tapes were developed. Still, after all these years no matter how hard people tried, simple tampering methods continue to violate privacy and leave envelopes or bags visually intact. Nowadays, in accompany with new technologies and worldwide web developments, electronic mails have become an important communication media among people. However, most consumers think that electronic mails are virtual, insubstantial and intangible, and may have safety problems during transfer. Therefore, conventional mails are still commonly used to deliver formal or important articles or items. To secure the safety and confidentiality of the mail becomes an important issue to be resolved.

It is well known that sometimes in the military, an officer can check a private mail by simply cutting a narrow slit on any side of the envelope to access the content, then gluing it back afterwards. Yet, the recipients will not notice the breakage.

Other conventional safety mails, such as express envelopes for delivering confidential documents, bank and credit card statements, credit cards or other important articles, face the same serious problem related to privacy and security.

For example, as shown in FIG. 6*a*, after an express envelope 70 is cut at its edge and forms a slit 71, items inside the envelope can be easily peeped or stolen from the slit edge; then, as shown in FIG. 6*b*, after the slit is recovered by re-seal or glue, not only will the envelope seem like it's never been opened, it will also be hard for the recipient to notice the breakage.

FIG. 7 shows a convention confidential envelope 80 having a tearing line 83 at the sealed side. Normally, breakage of the tearing line is a sign of being "already opened". However, an intruder can access the enclosure of the envelope from other portions, such as by cutting a slid 82 at the edge of the envelope 80; then glue it back easily afterwards without any sign or evidence for the recipient to notice. Other similar stealing or intrusion manners can also happen, and that make most currently used confidential envelopes meaningless and useless.

Therefore, it is required to have a confidential envelope that clearly shows evidence after being opened.

Japan publication number 61-110547 disclosed an envelope characterized in: using a strong coating paint to print texts, graphics and symbols onto any two opposite sides of the inner film (2*a*), forming the envelope and sealing the envelope by this printed side. In other words, before the envelope is sealed, a layer of printed texts, graphics or symbols is painted on its "inner surface". Since this printed layer is hidden in between the two sides of the envelope being sealed, it cannot be seem from outside when looking at the envelope. However, if the sealed area is peeled apart, the hidden printed layer will reveal and the printed texts, graphics or symbols will be separated as shown in FIG. 8.

SUMMARY OF THE INVENTION

The object of this invention is to provide a confidential envelope/bag that clearly shows evidence when being opened so that even before opening the envelope/bag, the recipient can easily notice whether the enclosure has been tampered or not.

A confidential envelope/bag according to this invention is composed of a face and a back. The left, right and bottom sides of the face are linked respectively with the left, right and bottom sides of the back and formed with edges. A covering lid is extended from top of the face. A folding line paralleled to and spaced with a suitable distance from the top of the back is formed on the lid. The envelope/bag is sealed by folding the lid and pasting it to the surface of the back.

The edges of the face, the back, and the top folding line form a sealing zone along the edges. Along the edges and the folding line, there are sealing prints of color regions, patterns, marks, graphics, texts, numbers made of paint, coating, ink, fluorescent dye, or even concaves, or extrusions. The sealing prints surround the circumference of the face, the back and across the two so that any intentional cut made for accessing the enclosure will leave noticeable evidence on the envelope/bag. Furthermore, the intruder has to make a long cut in the sealing zone to be able to take out the enclosure and it will leave an evident slit that is hard to remove.

There is a warning sign on the back of the envelope reminding the recipient to check whether or not the sealing zone has being broken; if so, the immediate remedial actions should be taken. There can also be a transparent portion on the face of the envelope allowing a certain content of the enclosure to expose.

BRIEF DESCRIPTION OF THE DRAWINGS

The invention will become more apparent from the detailed description given herein below. However, this description is for illustrations only and is not limitative of the invention, wherein.

DETAILED DESCRIPTION OF THE INVENTION

Figure 1:
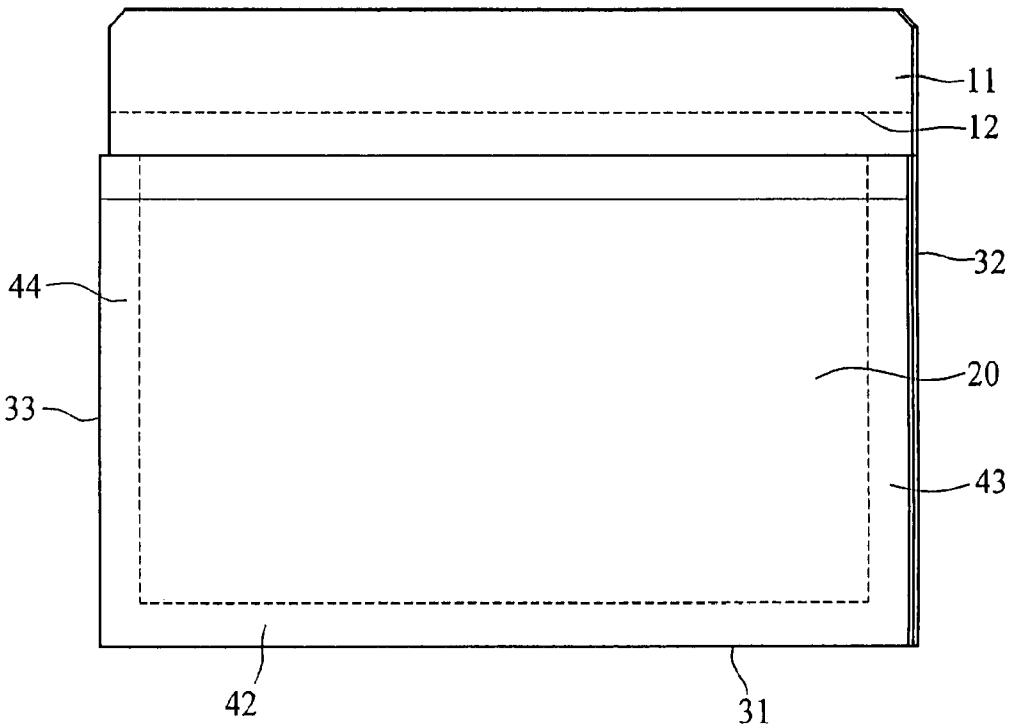
FIG. 1 is a rear view of a confidential envelope/bag of the invention before sealing.
Figure 2:
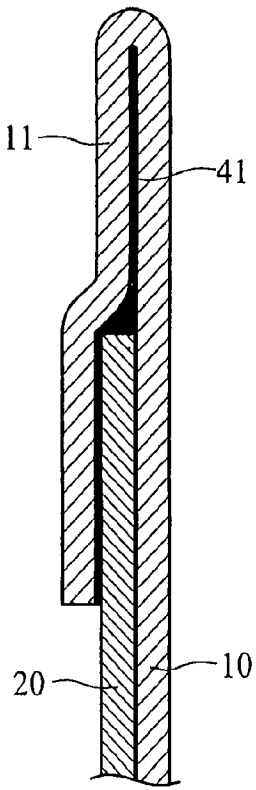
FIG. 2 is a partial side view of a sealed confidential envelope/bag of the invention.

FIG. 1 and FIG. 2 are rear and partial side views of a confidential envelope/bag of this invention. The envelope/bag is composed of a face 10 and a back 20. Bottom of the face 10 and the back 20 form a bottom edge 31. Both sides of the face 10 and the back 20 form two side edges 32, 33. An opening is formed on top of the face 10 and top of the back 20 for putting articles, such as letter, money, document, cards or valuables, in. The top of the face 10 extends to have a lid 11 for sealing the opening.

A folding line 12 paralleled to and spaced with a suitable distance from the top of the back 20 is formed on the lid 11. The envelope/bag is sealed by folding the lid 11 and pasting it to the surface of the back 20. There is an adhesive section prepared at the back of the lid 11 so that when being folded and pasted, a top sealing zone 41 is formed by the lid 11.

Besides the bottom edge 31 forming on the bottom of the face 10 and the bottom of the back 20, there is a suitable area of bottom sealing zone 42 formed between the bottom portions of the face 10 and the back 20. Like the top sealing zone 41, the bottom sealing zone 42 is an area where periphery portions of the face 10 and the back 20 are pasted and adhered to each other.

Besides the side edges 32, 33 forming on both sides of the face 10 and the back 20, there are two suitable areas of side sealing zones 43, 44 formed between both side portions of the face 10 and the back 20. Like the top sealing zone 41, the side sealing zones 43, 44 are areas where periphery portions of the face 10 and the back 20 are pasted and adhered to each other.

Figure 3:
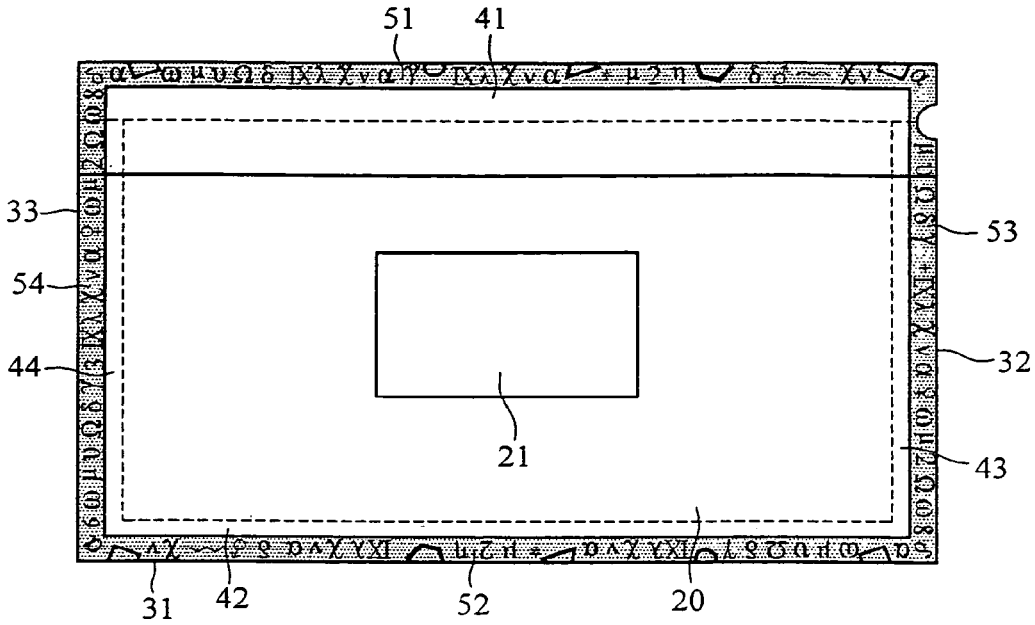
FIG. 3 is a rear view of a sealed confidential envelope/bag of the invention.
Figure 4:
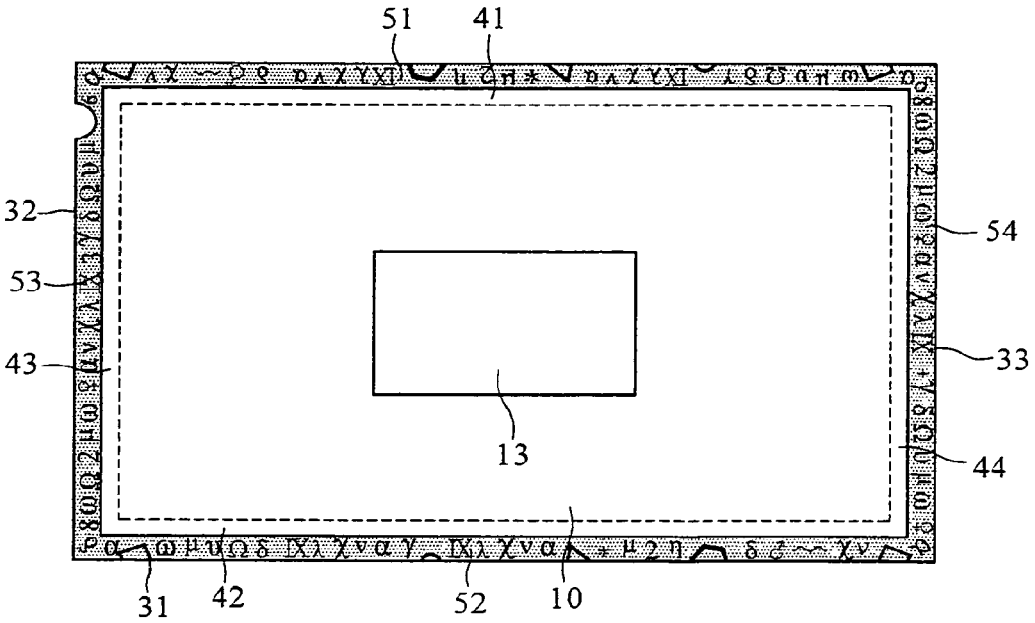
FIG. 4 is a front view of a sealed confidential envelope/bag of the invention.

Also referring to FIG. 3 and FIG. 4, a rear view and a front view of the sealed confidential envelope/bag, there is a sealing print 51 of color regions, patterns, marks, graphics, texts, numbers made of paint, coating, ink, fluorescent dye, or even concaves, or extrusions form on the lid 11 and around the folding line 12. After being folded, the sealing print 51 crosses the top portion of the face 10 and the back 20 so that any intentional cut for taking out the enclosure on the top portion will leave noticeable evidence on the envelope/bag. More specifically, the sealing print 51 is formed on the top outermost periphery portion of outer surfaces of the face 10 and the back 20. The top portion abuts the folding line 12 which itself is a top edge formed by the top of the face 10 and the back 20. The sealing print 51 crosses the top edge so as to extend from the face 10 to the back 20 without discontinuity.

Similarly, there is a sealing print 52 of color regions, patterns, marks, graphics, texts, numbers made of paint, coating, ink, fluorescent dye, or even concaves, or extrusions form on bottom portions of the face 10 and the back 20, and across the bottom edge 31 so that any intentional cut on the bottom portion will leave noticeable evidence on the envelope/bag. More specifically, the sealing print 52 is formed on the bottom outermost periphery portion of the outer surfaces of the face 10 and the back 20. The bottom portion abuts the bottom edge 31. The sealing print 51 crosses the bottom edge 31 so as to extend from the face 10 to the back 20 without discontinuity.

Also, there are two sealing prints 53, 54 of color regions, patterns, marks, graphics, texts, numbers made of paint, coating, ink, fluorescent dye, or even concaves, or extrusions form on two side portions of the face 10 and the back 20, and across the side edges 32, 33. Thus, any intentional cut for taking out the enclosure on any side portion will leave noticeable evidence on the envelope/bag. More specifically, the sealing prints 53, 54 are formed on two side outermost periphery portions of the outer surfaces of the face 10 and the back 20. The two side portions respectively abut the side edges 32, 33. The sealing prints 53, 54 respectively cross the side edges 32, 33 so as to extend from the face 10 to the back 20 without discontinuity.

Therefore, the circumference of the confidential envelope/bag is furnished with sealing zones 41, 42, 43, 44 and sealing prints 51, 52, 53, 54 after the envelope being sealed. Any intruder who intentionally cuts the envelope at any sealing zone 41, 42, 43 or 44 for taking out the enclosure will damage the sealing print 51, 52, 53 or 54. Because the sealing prints 51, 52, 53, 54 are color regions, patterns, marks, graphics, texts, numbers made of paint, coating, ink, fluorescent dye, or even concaves, or extrusions that cross the edges 12, 31, 32 and 33, any cutting or re-sealing is apparently noticeable due to the inconsistency of the sealing prints. Nevertheless, due to the surrounding sealing zones 41, 42, 43 and 44, the cut has to be wide enough for getting the enclosure and it is hard to recover or re-seal.

The concaves or extrusions on the sealing prints 51, 52, 53, 54 are for the blinds to check if the sealing prints are consistent. The printing materials for the sealing prints 51, 52, 53, 54 are selected according to different needs. For example, some kinds of invisible ink are used for military-purpose sealing printings that can only be seen through a specific machine. Thus, an intruder leaves noticeable breakage evidence easily without even aware it.

A notice portion 21 can be arranged at the back 20 for writing or printing warning notice to remind the recipient to check if any of the sealing zones 51, 52, 53 and 54 is being broken or missing.

There can also be a window 13 with transparent film on the face 10 to expose a certain content or information of the enclosure for informing the deliverer or recipient.

Figure 5:
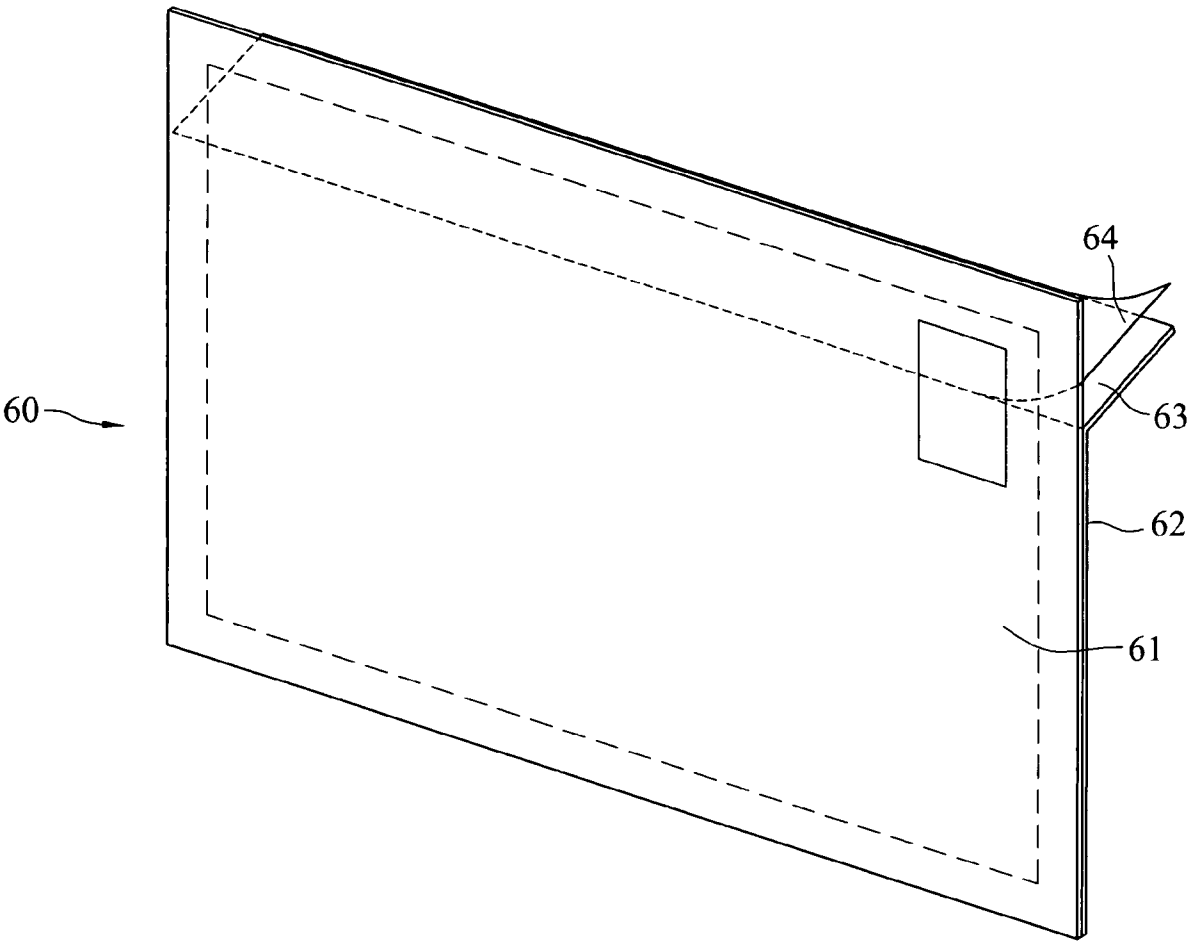
FIG. 5 is a perspective view of a confidential envelope/bag as a second embodiment of the invention.
Figure 6A:
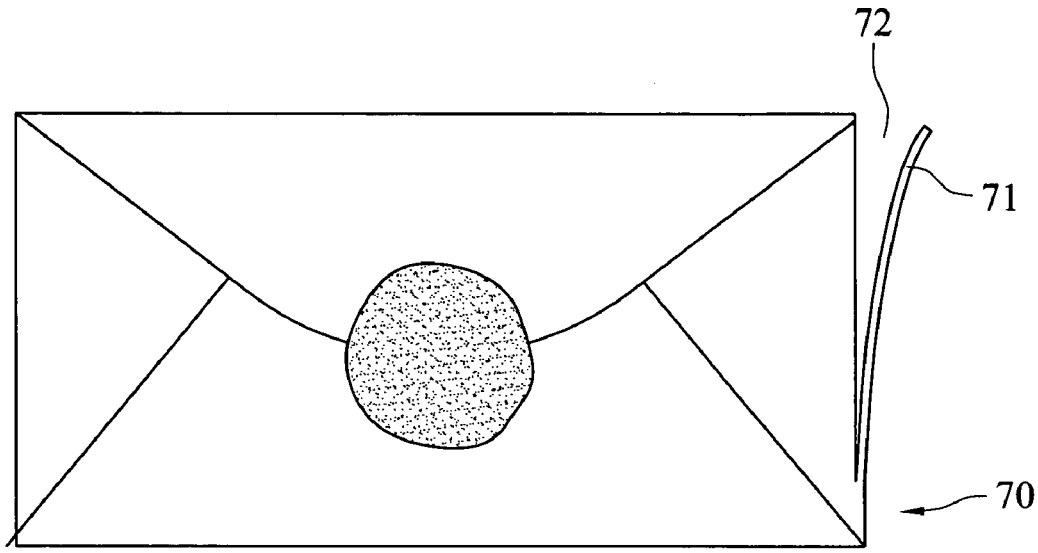
FIG. 6A (PRIOR ART)
FIG. 6A is a descriptive view of an envelope/bag being cut at the edge.
Figure 6B:
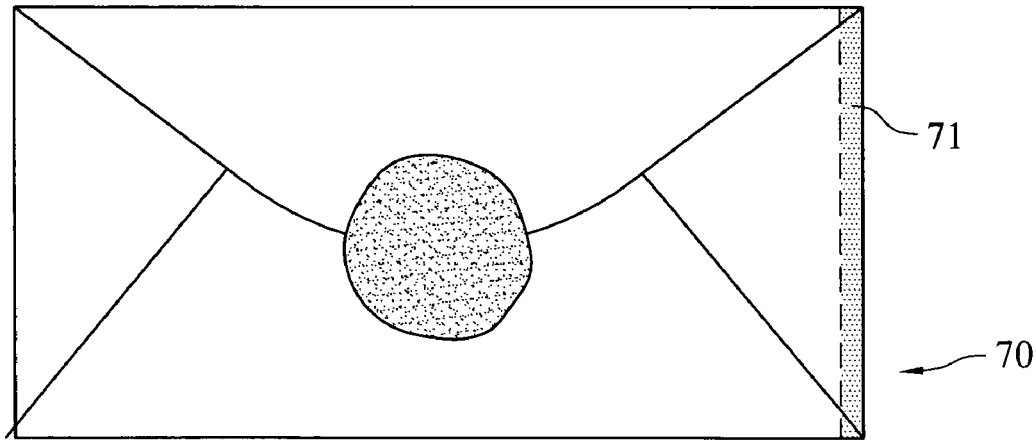
FIG. 6B (PRIOR ART)
FIG. 6B is a descriptive view of an envelope/bag being re-sealed at the cutting edge.
Figure 7:
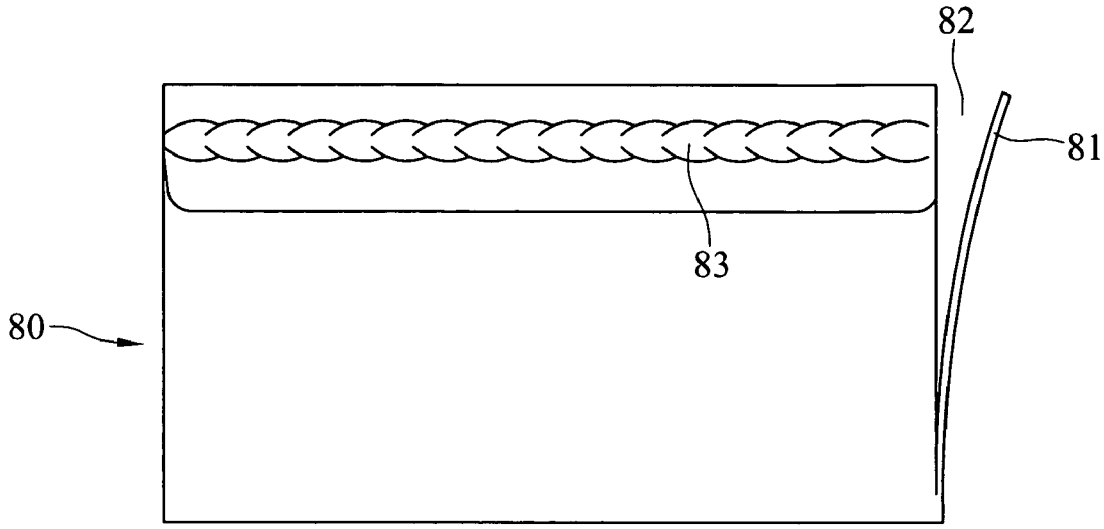
FIG. 7 (PRIOR ART)
FIG. 7 is a descriptive view of a conventional confidential envelope/bag having a sealing line at the sealed side.
Figure 8:
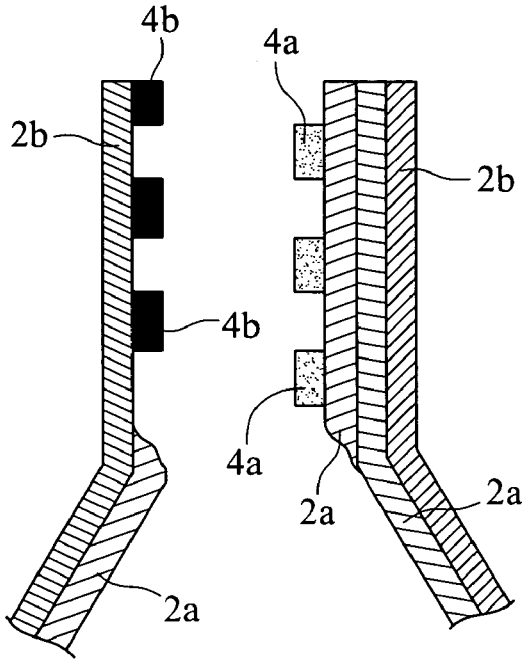
FIG. 8 (PRIOR ART)
FIG. 8 is an enlarged view of the broken seal of an envelope.

FIG. 5 shows a second embodiment of the invention. The confidential envelope/bag has a face 61 and a back 62. On the inner top surfaces of the face 61 and the back 62 respectively, there are two adhesive surfaces 63 covered with parting papers 64. Upon removing the parting papers 64, the top portions of the face 61 and the back 62 are sealed to form a top sealing zone having the same functions as of the first embodiment described above.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A confidential envelope/bag, comprising:

a face and a back, said face and said back being linked with each other at an edge, the edge defining a boundary between said face and said back, periphery portions of said face and said back being adhered to each other to form a sealing zone within said face and said back; and a sealing print formed on each of a top outermost periphery portion within the sealing zone, a bottom outermost periphery portion within the sealing zone, and two side outermost periphery portions of both said face and said back within the sealing zone, the sealing print being formed on outer surfaces of both said face and said back, said outermost periphery portions abutting said edge, the sealing print crossing said edge so as to extend from said face to said back without discontinuity, wherein an area of the sealing print is smaller than an area of the sealing zone.

2. The confidential envelope/bag according to claim 1 wherein said sealing print is made of at least one of paint, coating, ink and fluorescent dye.

3. The confidential envelope/bag according to claim 1 wherein said sealing print comprises at least one of marks, graphics, texts, numbers, concaves and extrusions.

4. The confidential envelope/bag according to claim 1 wherein said back is prepared with a portion for carrying notice.

5. The confidential envelope/bag according to claim 1 wherein said face is formed with a transparent window.

* * * * *